US009389555B2

(12) United States Patent
Omura

(10) Patent No.: US 9,389,555 B2
(45) Date of Patent: Jul. 12, 2016

(54) FIXING DEVICE

(71) Applicant: KYOCERA Document Solutions Inc., Osaka (JP)

(72) Inventor: Hiroyoshi Omura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/858,238

(22) Filed: Sep. 18, 2015

(65) Prior Publication Data

US 2016/0091843 A1 Mar. 31, 2016

(30) Foreign Application Priority Data

Sep. 30, 2014 (JP) ..... 2014-200046
Sep. 30, 2014 (JP) ..... 2014-200095

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2053; G03G 15/2028; G03G 2215/2032; G03G 15/205; G03G 15/2042; G03G 15/2064; G03G 2215/2016; G03G 2215/20; G03G 2215/2035; G03G 15/2057; G03G 2215/2045; G03G 15/2025
See application file for complete search history.

(56) References Cited

U.S. PATENT DOCUMENTS 6,791,671 B1 * 9/2004 Hayashi ..... G03G 15/2039 219/216
2001/0048831 A1 * 12/2001 Matsumoto ..... B65H 33/08 399/405

FOREIGN PATENT DOCUMENTS

JP 08-328406 12/1996

* cited by examiner

*Primary Examiner* — Roy Y Yi
(74) *Attorney, Agent, or Firm* — Wenderoth, Lind & Ponack, L.L.P.

(57) ABSTRACT

A fixing device includes a temperature detection unit that detects temperature associated with temperature of an abutting section of a fixing roller and a pressing roller, and a control unit that controls a driving motor based on detection temperature by the temperature detection unit. When the fixing device is activated, if it is determined that detection temperature by the temperature detection unit is not equal to or less than predetermined temperature, the control unit drives the driving motor at a setting speed set in advance, and if it is determined that the detection temperature is equal to or less than the predetermined temperature K, the control unit drives the driving motor at a predetermined low speed lower than the setting speed.

9 Claims, 5 Drawing Sheets

FIXING DEVICE

CROSS-REFERENCE TO RELATED APPLICATION

This application is based upon and claims the benefit of priority from Japanese Patent Application No. 2014-200046 filed on Sep. 30, 2014 and Japanese Patent Application No. 2014-200095 filed on Sep. 30, 2014, the entire contents of which are incorporated herein by reference.

BACKGROUND

The technology of the present disclosure relates to a fixing device in an image forming apparatus such as a printer, a copy machine, a facsimile, and a multifunctional peripheral thereof.

Conventionally, as a fixing device mounted in an image forming apparatus, there has been proposed a device in which a paper carrying a toner image is interposed between a fixing roller and a pressing roller and is conveyed, so that the toner image is molten by heat of the fixing roller and is fixed to the paper. In this fixing device, one roller is rotationally driven by a motor, so that the other roller is driven and rotated. The surface of the pressure roller, for example, is configured with a rubber material.

SUMMARY

A fixing device according to one aspect of the present disclosure includes a fixing roller heated by a heating unit, a pressing roller brought into press-contact with the fixing roller, and a driving motor for driving a driving roller including the fixing roller or the pressing roller.

At least one of a peripheral surface of the fixing roller and a peripheral surface of the pressing roller is configured with a rubber member. The fixing device further includes a temperature detection unit and a control unit. The temperature detection unit detects temperature associated with temperature of an abutting section of the fixing roller and the pressing roller. The control unit controls the driving motor based on detection temperature by the temperature detection unit. The control unit is configured to determine whether the detection temperature detected by the temperature detection unit is equal to or less than predetermined temperature when the fixing device is activated, to drive the driving motor at a setting speed set in advance when it is determined that the detection temperature is not equal to or less than the predetermined temperature, and to rotationally drive the driving motor at a predetermined low speed lower than the setting speed when it is determined that the detection temperature is equal to or less than the predetermined temperature.

DETAILED DESCRIPTION

Hereinafter, an embodiment will be described in detail with reference to the drawings. It is noted that the technology of the present disclosure is not limited to the following embodiment.

Embodiment

Figure 1:
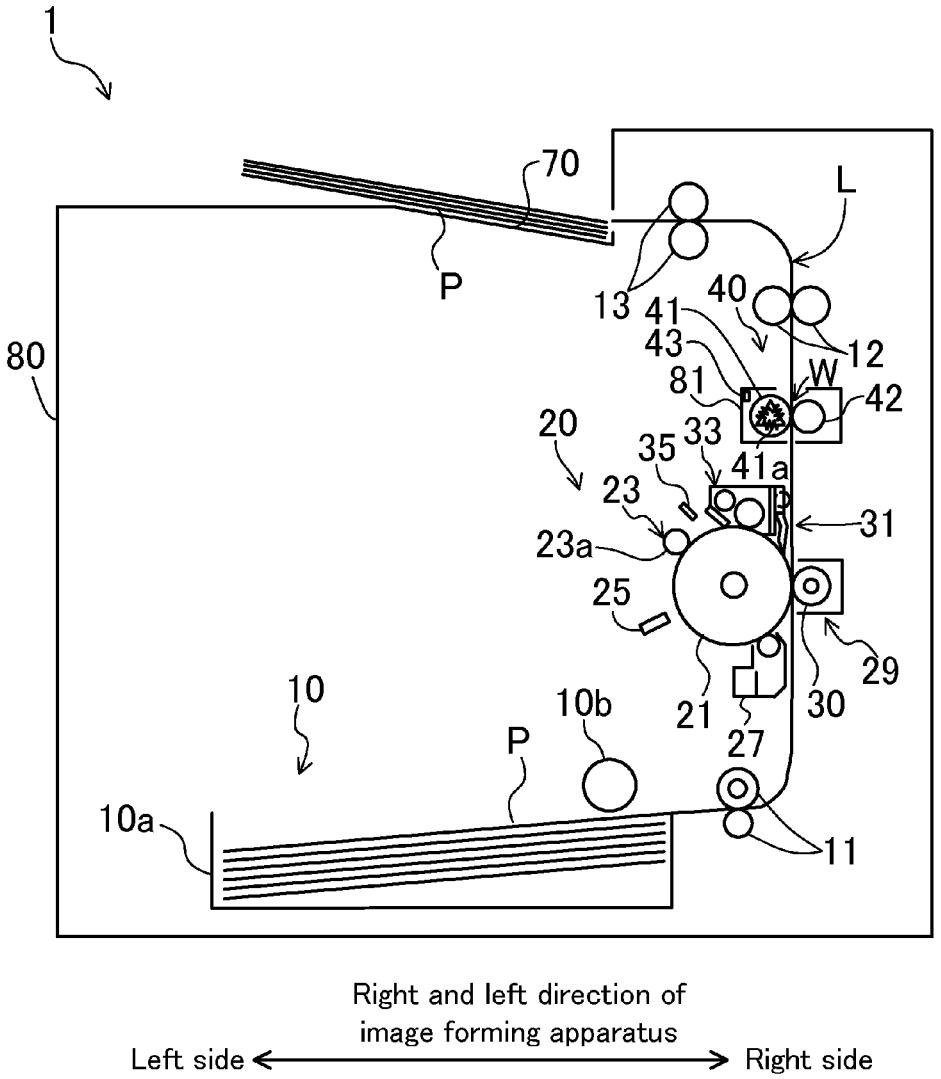
FIG. 1 is a schematic diagram illustrating an image forming apparatus including a fixing device in an embodiment.

FIG. 1 illustrates an image forming apparatus 1 in the present embodiment. In the present embodiment, the image forming apparatus 1 includes a monochrome laser printer. The image forming apparatus 1 has a paper feeding unit 10, an image creating unit 20, a fixing device 40, a paper discharge unit 70, and a housing 80. On a paper conveyance path from the paper feeding unit 10 to the paper discharge unit 70, a plurality of conveying roller pairs 11 to 13 are arranged to convey a paper P while interposing it therebetween. In the following description, it is noted that a "front side" and a "rear side" indicate a front side and a rear side (a front side and a back side in a direction vertical to the paper surface of FIG. 1) of the image forming apparatus 1, and a "left side" and a "right side" indicate a left side and a right side when the image forming apparatus 1 is viewed from the front side.

The paper feeding unit 10 has a paper feeding cassette 10*a* in which the paper P having a sheet shape is accommodated, and a pick-up roller 10*b* for taking out the paper P in the paper feeding cassette 10*a* and sending out the paper P to an exterior of the cassette. The paper P sent out to the exterior of the cassette from the paper feeding cassette 10*a* is supplied to the image creating unit 20 via the conveying roller pair 11.

The image creating unit 20 is arranged at an intermediate portion of a right end part of the housing 80 in a vertical direction. The image creating unit 20 has a photosensitive drum 21, wherein around the photosensitive drum 21, a charging device 23, an exposure device 25, a developing device 27, a transfer device 29, a cleaning device 33, and an electricity removing device 35 are sequentially arranged in a counterclockwise direction of FIG. 1 on a basis of a 10 o'clock direction.

At the time of image formation, a peripheral surface of the photosensitive drum 21 is firstly electrified by the charging device 23. Then, laser light based on document image data (for example, image data of a document image received from an external terminal) is irradiated to the peripheral surface of the photosensitive drum 21 by the exposure device 25. In this way, an electrostatic latent image corresponding to the document image data is formed on the surface of the photosensitive drum 21. The electrostatic latent image formed on the peripheral surface of the photosensitive drum 21 is developed by the developing device 27 as a toner image. The toner image developed in this way is transferred to the paper P supplied from the paper feeding unit 10 when the paper P passes through between the photosensitive drum 21 and a transfer roller 30 of the transfer device 29. Remaining toner remaining on the peripheral surface of the photosensitive drum after the toner image is transferred to the paper P is collected by the cleaning device 33, and charge of the peripheral surface of the photosensitive drum 21 is removed by the electricity removing device 35. On the other hand, the paper P with the transferred toner image is sent out to the fixing device 40 positioned at a downstream side of the transfer device 29 (the transfer roller 30) and the photosensitive drum 21 by the transfer device 29 and the photosensitive drum 21. It is noted that a reference numeral 31 of FIG. 1 is a separating device that separates the paper P from the photosensitive drum 21 such that the paper P is not rolled into the cleaning device 33.

The aforementioned fixing device 40 has a fixing roller 41, a pressing roller 42 brought into press-contact with the fixing roller 41, and a box-like case body 81 that accommodates both rollers 41 and 42 therein. In the fixing device 40, the paper P supplied by the image creating unit 20 is interposed by the fixing roller 41 and the pressing roller 42 and is conveyed, so that the toner image is fixed to the paper P. Then, the paper P with the toner image fixed by the fixing device 40 is sent out to the downstream side by both rollers 41 and 42. The paper P sent out from the fixing device 40 is discharged to the aforementioned paper discharge unit 70 formed on an upper surface of the housing 80 via the plurality of conveying roller pairs 12 and 13.

Figure 2:
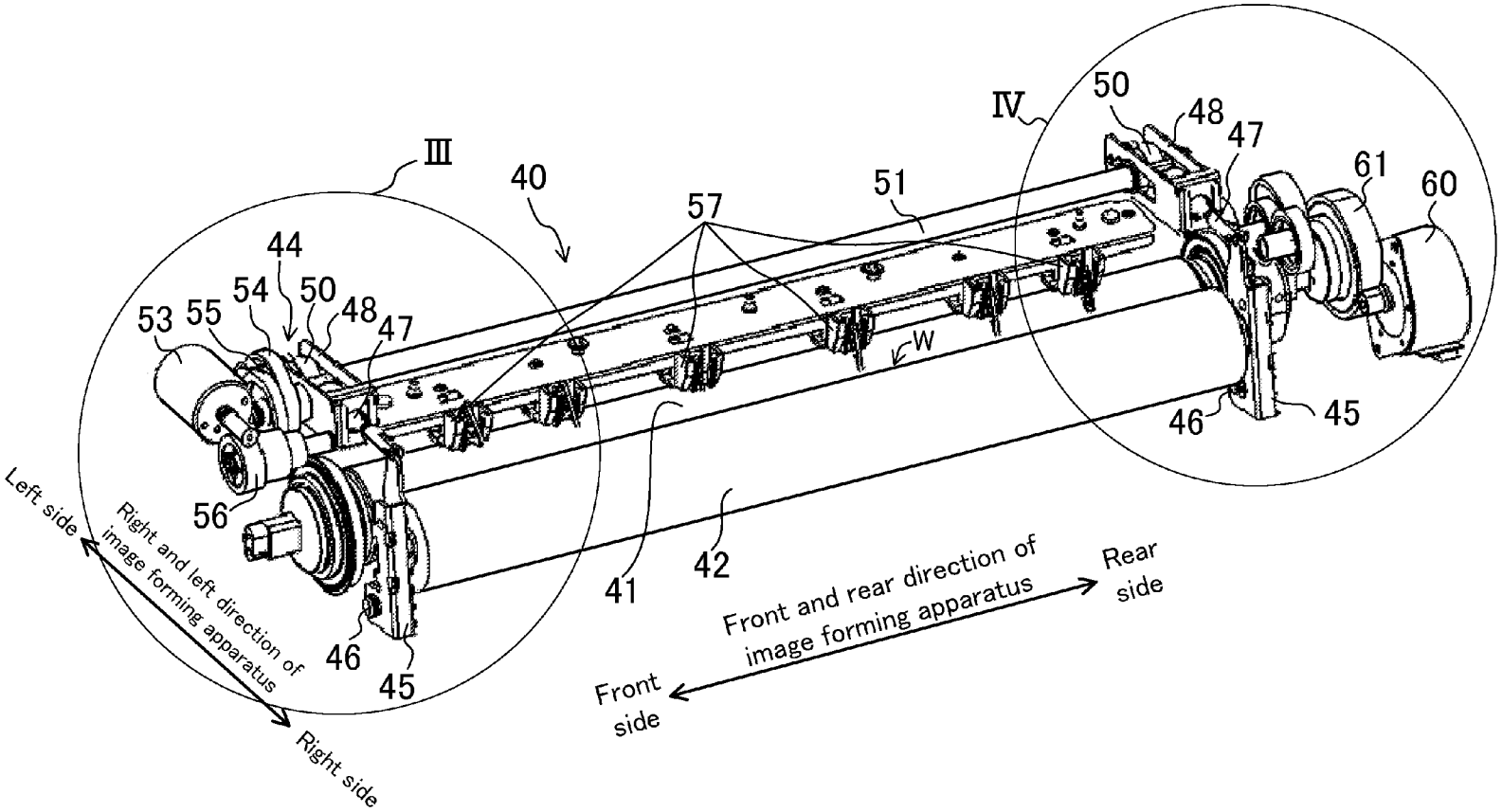
FIG. 2 is a perspective view illustrating a fixing device.

FIG. 2 is a perspective view when an interior of the aforementioned fixing device 40 is viewed from a diagonal right side of a front side of the printer. Both the fixing roller 41 and the pressing roller 42 are formed in a cylindrical shape extending in a front and rear direction of the image forming apparatus 1. In the present embodiment, the fixing roller 41 is a driving roller and the pressing roller 42 is a driven roller that is rotated according to the driving roller. A reference numeral 60 of FIG. 2 is a driving motor 60 for driving the fixing roller 41. A gear 63 (see FIG. 4) is fixed to one end portion of the fixing roller 41, and the driving motor 60 is connected to the gear 63 via two gears 61 and 62. In the present embodiment, the driving motor 60 is configured by a stepping motor and its operation is controlled by a controller (a control unit) 100 which will be described later.

Both the surfaces of the fixing roller 41 and the pressing roller 42 are configured with a rubber member (for example, EDPM). The fixing roller 41 has a heater (a heating unit) 41*a* for heating the surface of the fixing roller 41 incorporated therein. The fixing roller 41 is provided with a lateral side thereof with a fixing temperature sensor (a fixing temperature detection unit) 43 (see FIG. 1) for measuring its surface temperature. The fixing temperature sensor 43 is a sensor capable of measuring the surface temperature of the fixing roller 41 in a non-contact manner. When the surface temperature of the fixing roller 41 is high, the temperature of an abutting section W of both rollers 41 and 42 also becomes high, and when the surface temperature of the fixing roller 41 is low, the temperature of the abutting section W of both rollers 41 and 42 also becomes low. That is, it can be said that the surface temperature of the fixing roller 41 is temperature (temperature having correlation) associated with the temperature of the abutting section W between the fixing roller 41 and the pressing roller 42. The fixing temperature sensor 43 is electrically connected to the controller 100 (see FIG. 5). The fixing temperature sensor 43 detects the surface temperature of the fixing roller 41 and transmits a detection signal to the controller 100. Details of the controller 100 will be described later.

Figure 3:
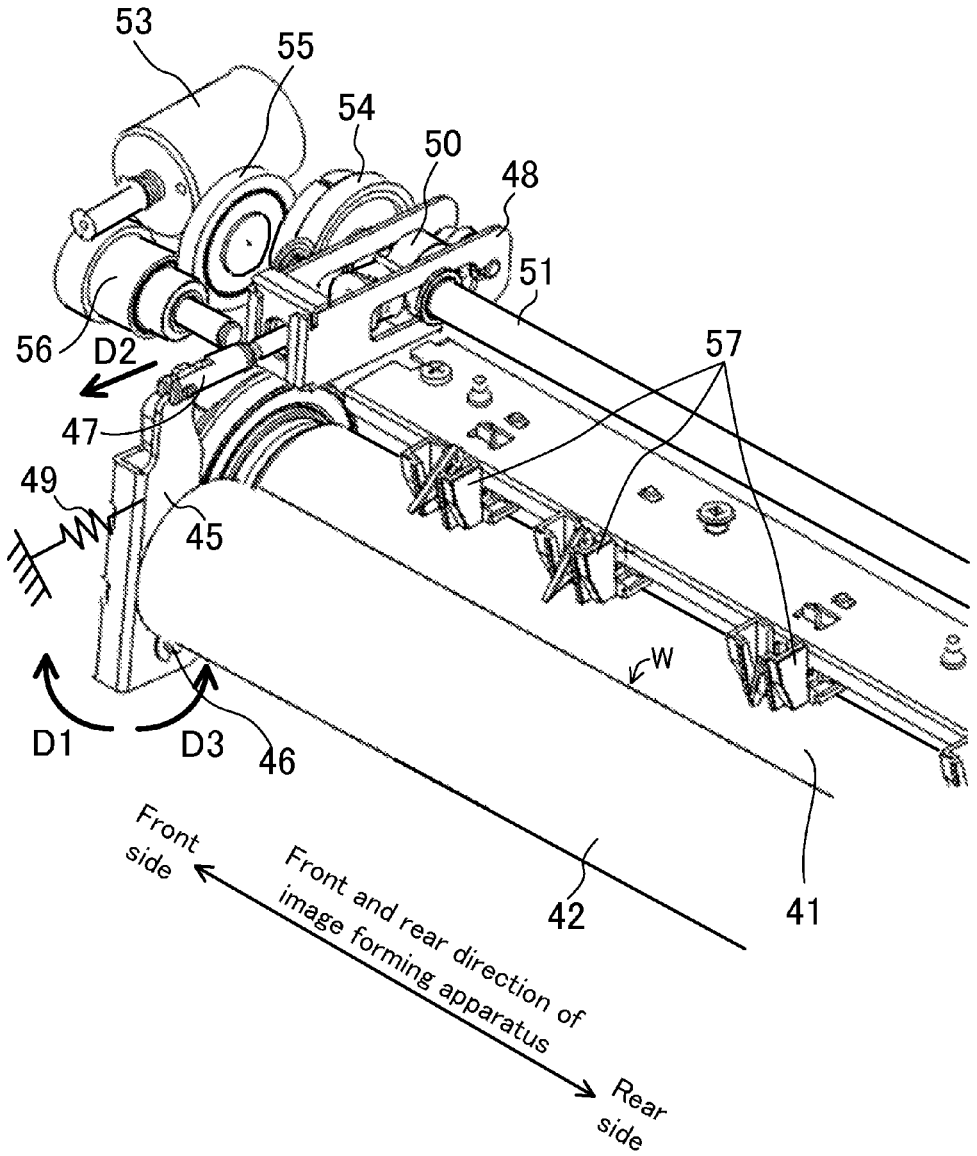
FIG. 3 is an enlarged perspective view illustrating details of a part III of FIG. 2.
Figure 4:
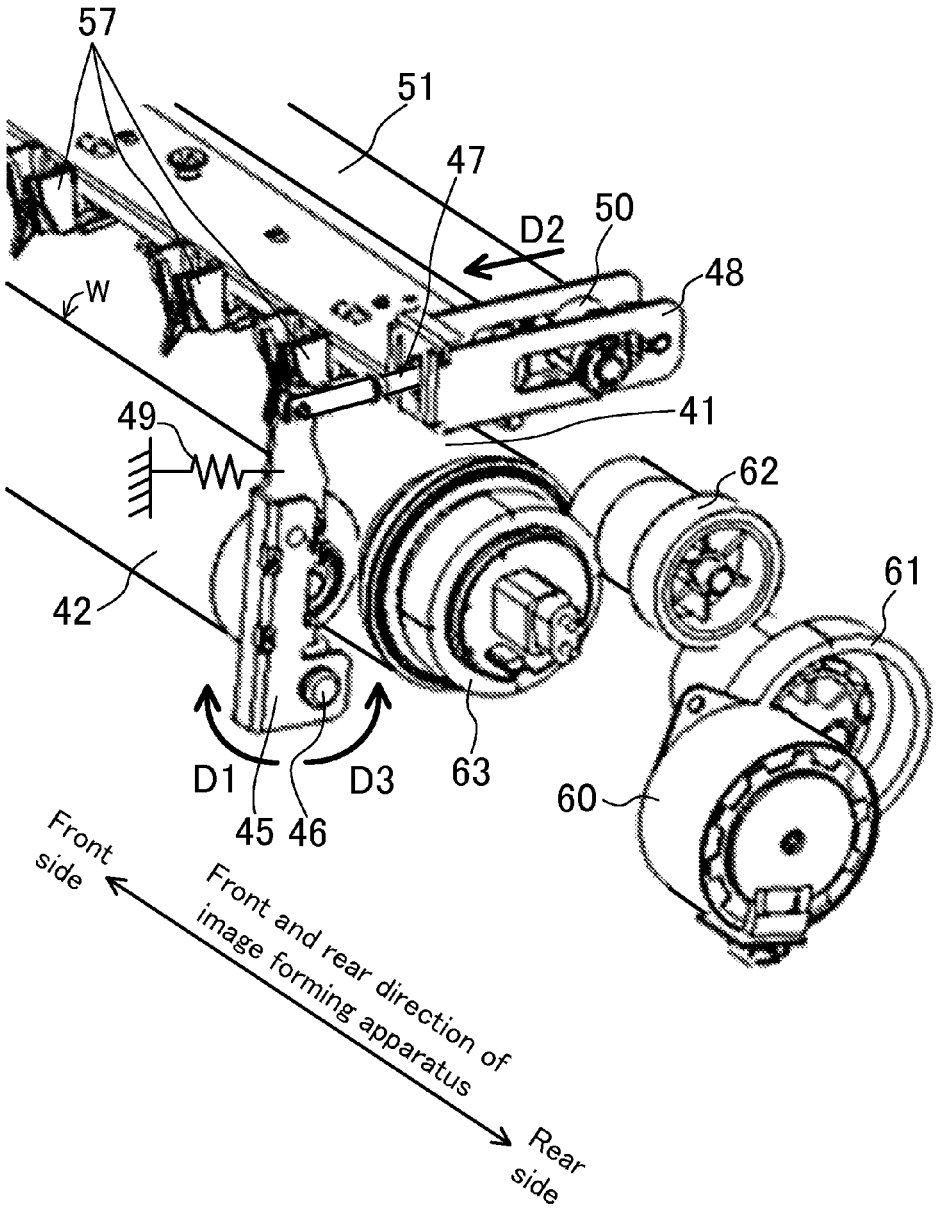
FIG. 4 is an enlarged perspective view illustrating details of a part IV of FIG. 2.

As illustrated in FIG. 2 to FIG. 4, the aforementioned fixing device 40 has a pressure switching mechanism 44 in addition to the fixing roller 41 and the pressing roller 42. The pressure switching mechanism 44 is a mechanism that switches a pressing state in which the pressing roller 42 abuts the fixing roller 41 with predetermined pressing load and a pressing release state in which the pressing roller 42 abuts the fixing roller 41 with pressing load lower than that of the pressing state. In response to the type (a plain paper, an envelope, a heavy paper and the like) of the paper P, the pressing roller 42 is switched to the pressing state and the pressing release state by the pressure switching mechanism 44, so that it is possible to avoid the occurrence of winkles and the like in the paper P. It is noted that the pressing release state also includes a state in which the pressing load is 0.

In detail, the aforementioned pressure switching mechanism 44 has a pair of link members 45 that rotatably support both end portions of the pressing roller 42. The pair of link members 45 are arranged spaced apart from each other in the front and rear direction while facing each other. Both end portions of the pressing roller 42 are supported to an intermediate portion of each link member 45 in the vertical direction. A lower end portion of each link member 45 is rotatably supported to a support pin 46. A shaft line of the support pin 46 extends in the front and rear direction, and the support pin 46 is fixed to a sidewall of the case body 81 (illustrated only in FIG. 1). An upper end portion of each link member 45 is coupled to a front end portion of a rod 47. A shaft line of each rod 47 extends in a right and left direction. Each rod 47 is supported by a guide member 48 so as to be slidable in the right and left direction. Each guide member 48 is fixed to the sidewall of the case body 81 (illustrated only in FIG. 1). A base end portion of each rod abuts a peripheral surface of a rotating cam 50. Each rotating cam 50, for example, is formed in an elliptic cylindrical shape. Each rotating cam 50 is integrally and rotatably connected to a cam connecting shaft 51. Both end portions of the cam connecting shaft 51 are rotatably supported to the aforementioned pair of guide members 48, respectively. Moreover, as illustrated in the drawings, one end portion of the cam connecting shaft 51 is connected to an output shaft of a switching motor 53 via gears 54 to 56. The operation of the switching motor 53 is controlled by the controller 100 which will be described later.

As illustrated in FIG. 3 and FIG. 4, an urging spring 49 is connected to a slightly lower side from an upper end of the aforementioned link member 45. The urging spring 49 includes a compression coil spring. The urging spring 49 has one end fixed to the link member 45 and the other end fixed to the case body 81. Accordingly, the urging spring 49 urges the link member 45 in a direction of an arrow D1 of FIG. 3 and FIG. 4 around the support pin 46. In the state of FIG. 3 and FIG. 4, the pressing roller 42 is brought into press-contact with the fixing roller 41 by urging force of the urging spring 49. In other words, the fixing roller 41 and the pressing roller 42 enter the pressing state in which they abut each other with the predetermined pressing load. When both rollers 41 and 42 are switched from the pressing state to the pressing release state, the switching motor 53 is driven by the controller 100 in a predetermined direction. In this way, since the cam connecting shaft 51 and the rotating cam 50 rotate in the predetermined direction, the base end portion of the rod 47 is pressed by the peripheral surface of the rotating cam 50, so that the rod 47 moves in a direction of an arrow D2 of FIG. 3 and FIG. 4. As a consequence, the link member 45 rotates in a direction of an arrow D3 about the support pin 46. Therefore, the pressing roller 42 held to the link member 45 slightly moves in a direction separated from the fixing roller 41. Accordingly, the fixing roller 41 and the pressing roller 42 are switched from the pressing state to the pressing release state.

Figure 5:
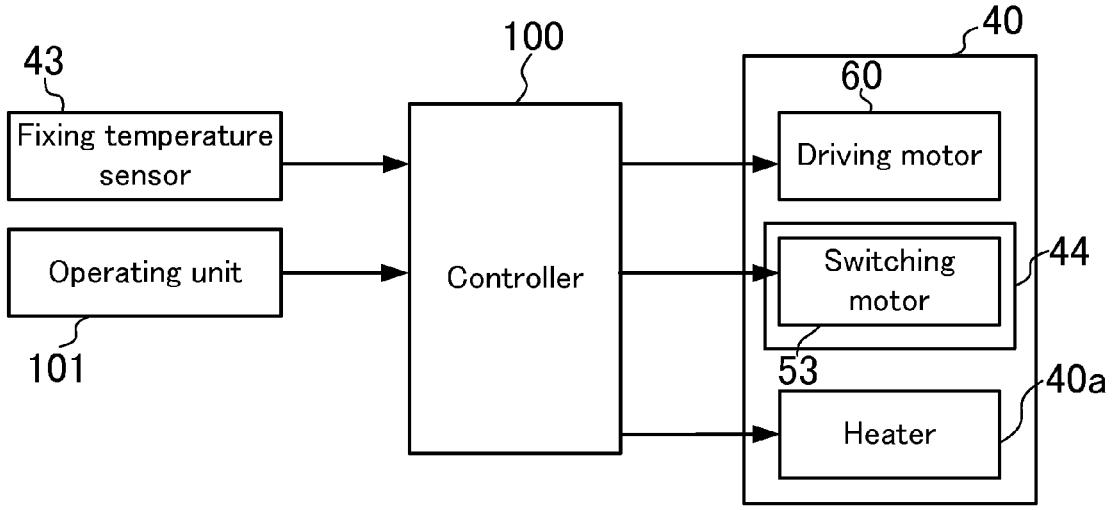
FIG. 5 is a block diagram illustrating a part of a control system of an image forming apparatus.

FIG. 5 simply illustrates a part of the control system of the image forming apparatus 1. The control system has the controller 100. The controller 100 is configured by a microcomputer having CPU, ROM, RAM and the like. The controller 100 controls the operations of the image creating unit 20 and the fixing device 40 based on signals from an operating unit 101 and the fixing temperature sensor 43.

The operating unit 101 includes an operating key, a power switch and the like provided on an operating panel (not illustrated). The operating unit 101 detects that the operating key or the power switch has been operated by a user, and outputs an operating signal to the controller 100. The fixing temperature sensor 43 detects the surface temperature of the fixing roller 41 and outputs the detected temperature signal to the controller 100 as described above.

When it is determined that the power switch has been turned on based on the operating signal from the operating unit 101, the controller 100 performs a warm-up process of the image forming apparatus 1. The warm-up process, for example, includes a calibration process and the like of various sensors. After the warm-up process ends, the image forming apparatus 1 enters a ready state. The ready state indicates a state in which the image forming apparatus 1 is powered on and an image forming process can be performed at any time.

Hereinafter, an example of the warm-up process in the controller 100 will be described. When it is determined that the power switch has been turned on, the controller 100 activates the fixing device 40. When activating the fixing device 40, the controller 100 firstly operates the heater 41*a* to heat the fixing roller 41 from an interior. Next, the controller 100 determines whether detection temperature detected by the fixing temperature sensor 43 is equal to or less than predetermined temperature K, and allows the fixing roller 41 and the pressing roller 42 to enter the pressing state by the pressure switching mechanism 44 and then starts to drive the driving motor 60 when it is determined that the detection temperature exceeds the predetermined temperature K. At this time, a rotation speed of the driving motor 60 is controlled to a setting speed V1 set in advance by the controller 100.

On the other hand, when it is determined that the detection temperature by the fixing temperature sensor 43 is equal to or less than the predetermined temperature K, the controller 100 allows the fixing roller 41 and the pressing roller 42 to enter the pressing release state by the pressure switching mechanism 44 and starts to drive the driving motor connected to the fixing roller 41. At this time, the rotation speed of the driving motor 60 is controlled to a predetermined low speed V2 lower than the aforementioned setting speed V1 by the controller 100. After the driving of the driving motor 60 starts, when a predetermined time T has lapsed, the controller 100 switches the fixing roller 41 and the pressing roller 42 from the pressing release state to the pressing state by the pressure switching mechanism 44 and switches the rotation speed of the driving motor 60 from the predetermined low speed V2 to the setting speed V1.

The aforementioned predetermined time T has been preset as a time at which the temperature of the abutting section W of both rollers 41 and 42 exceeds predetermined threshold temperature S when the predetermined time T has lapsed from the driving start of the aforementioned driving motor 60. When the temperature of the abutting section W of both rollers 41 and 42 exceeds the threshold temperature S, driving resistance in the abutting section W of both rollers 41 and 42 becomes less than a predetermined value. After the driving of the driving motor 60 starts, the controller 100 ends the aforementioned warm-up process when the predetermined time T has lapsed. That is, the aforementioned predetermined time T coincides with a warm-up time of the image forming apparatus 1.

As described above, in the aforementioned embodiment, at the time of activation of the fixing device 40, when it is determined that the detection temperature detected by the fixing temperature sensor 43 is not equal to or less than the predetermined temperature K (when the fixing device 40 is under the normal temperature and high temperature environment), the controller 100 is configured to drive the driving motor 60 at the setting speed V1 set in advance, and when it is determined that the aforementioned detection temperature is equal to or less than the predetermined temperature K (when the fixing device 40 is under the low temperature environment), the controller 100 is configured to rotationally drive the driving motor 60 at the predetermined low speed V2 lower than the setting speed.

Consequently, under the low temperature environment (for example, 10° C. or less), it is possible to suppress output torque of the driving motor 60 required at the time of activation of the fixing device to be low as compared with that under the normal temperature and high temperature environment.

That is, under the low temperature environment, the driving resistance in the abutting section of both rollers 41 and 42 increases or a bearing member supporting each of the rollers 41 and 42 is contracted due to a shape change caused by a change in rubber hardness, so that driving torque for rotating both rollers 41 and 42 increases from about 1.5 times to about two times as compared with that under the normal temperature environment. As a consequence, there has been a problem that the driving motor 60 increases in size. However, in the aforementioned embodiment, in consideration of the fact that the driving resistance in the abutting section W of both rollers 41 and 42 becomes large in proportion to an increase in the rotation speeds of both rollers 41 and 42, when activating the fixing device 40 under the low temperature environment, a driving speed of the driving motor 60 is set to be low as compared with that under the normal temperature and high temperature environment. Therefore, it is possible to minimize the driving resistance in the abutting section W of both rollers 41 and 42 at the time of activation of the fixing device 40. In this way, at the time of activation of the fixing device 40 under the low temperature environment, even though the output torque of the driving motor 60 is low, it is possible to reliably drive the driving roller (the fixing roller 41), thereby enabling the miniaturization of the driving motor 60.

As a result of earnest research, an applicant has found that when the predetermined low speed V2 is equal to or less than ½ of the setting speed V1, the driving resistance in the abutting section W of both rollers 41 and 42 particularly becomes small. Consequently, it is preferable that the predetermined low speed V2 is equal to or less than ½ of the setting speed V1. In this way, the driving torque of the driving roller (the fixing roller 41) at the time of activation of the fixing device 40 is sufficiently reduced, so that it is possible to further promote the miniaturization of the driving motor 60.

At the time of activation of the fixing device 40, when it is determined that the detection temperature detected by the fixing temperature sensor 43 is equal to or less than the predetermined temperature K, the controller 100 is configured to drive the driving motor 60 at the predetermined low speed V2 for the predetermined time T and then to switch the speed of the driving motor 60 to the setting speed V1.

According to the configuration, the driving motor 60 is driven by the controller 100 at the predetermined low speed V2 for the predetermined time T, and then the speed of the driving motor 60 is switched from the predetermined low speed V2 to the setting speed V1 (>the predetermined low speed V2) by the controller 100. By the speed switching, a fixing speed to a paper becomes fast, but the driving resistance in the abutting section W of the fixing roller 41 and the pressing roller 42 increases. However, in the aforementioned embodiment, at the time of the speed switching (that is, when the predetermined time T has lapsed after the driving of the driving motor 60 starts at the predetermined low speed V2), since the temperature of the abutting section W of both rollers 41 and 42 exceeds the predetermined threshold temperature S, the driving resistance in the abutting section W and the contraction amount of the bearing member supporting both rollers 41 and 42 become sufficiently small. Consequently, even after the speed of the driving motor 60 is switched to the setting speed V1, it is possible to reliably drive the fixing roller 41 (the driving roller) with sufficient torque by the driving motor 60.

Furthermore, in the aforementioned embodiment, at the time of activation of the fixing device 40, when it is determined that the detection temperature detected by the fixing temperature sensor 43 is equal to or less than the aforementioned predetermined temperature K, the controller 100 is configured to allow the fixing roller 41 and the pressing roller 42 to enter the pressing release state by the pressure switching mechanism 44 and then drive the driving motor 60, and to switch both rollers 41 and 42 to the pressing state by the pressure switching mechanism 44 after the driving of the driving motor 60 starts. Consequently, under the low temperature environment (for example, 10° C. or less) and the like in which large driving torque than usual is assumed to be required, after the fixing roller 41 and the pressing roller 42 enter the pressing release state by the pressure switching mechanism 44, the driving of the driving motor 60 starts. In this way, it is possible to suppress the driving torque of the driving roller (the fixing roller 41), which is required at the time of activation of the fixing device 40 under the low temperature environment, to be low.

Thus, under the low temperature environment, even though the output torque of the driving motor 60 is low, it is possible to reliably drive the driving roller (the fixing roller) 41. Accordingly, it is possible to achieve the miniaturization of the driving motor 60.

Furthermore, in the aforementioned embodiment, after the driving of the driving motor 60 starts, when the predetermined time T has lapsed, both rollers 41 and 42 are switched to the pressing state by the pressure switching mechanism 44. When both rollers 41 and 42 are switched to the pressing state, the driving resistance in the abutting section W of both rollers 41 and 42 increases as compared with that in the pressing release state. However, at the time of the switching, that is, when the predetermined time T has lapsed after the driving of the driving motor 60 starts, since the temperature of the abutting section W of both rollers 41 and 42 exceeds the predetermined threshold temperature S, the driving resistance in the abutting section W and the contraction amount of the bearing member supporting both rollers 41 and 42 sufficiently become small. Consequently, it is possible to reliably drive the fixing roller 41 (the driving roller) without increasing the driving motor 60 in size.

Furthermore, in the aforementioned embodiment, at the time of activation of the fixing device 40, when it is determined that the detection temperature detected by the fixing temperature sensor 43 exceeds the aforementioned predetermined temperature K, the controller 100 is configured to allow the fixing roller 41 and the pressing roller 42 to enter the pressing state by the pressure switching mechanism 44 and then drive the driving motor 60. Consequently, under the normal temperature and high temperature environment in which the driving resistance in the abutting section W and the contraction amount of the bearing member supporting both rollers 41 and 42 are small, since it is not necessary to initially drive the driving motor 60 after both rollers 41 and enter the pressing release state as under the low temperature environment, it is possible to shorten an activation time of the fixing device 40.

Furthermore, in the aforementioned embodiment, focusing on the fact that the driving resistance in the abutting section of the fixing roller 41 and the pressing roller 42 increases in proportion to the rotation speeds of both rollers 41 and 42, when activating the fixing device 40 under the low temperature environment, the driving start speed of the driving motor 60 is set to the predetermined low speed V2 lower than the setting speed V1 set in advance. In this way, it is possible to more reliably reduce the driving resistance in the abutting section W of both rollers 41 and 42 at the time of activation of the fixing device 40 under the low temperature environment.

As a result of earnest study, an applicant has found that when the aforementioned predetermined low speed V2 is equal to or less than ½ of the aforementioned setting speed V1, the driving resistance in the abutting section of both rollers particularly becomes small. Thus, it is preferable that the aforementioned predetermined low speed V2 is equal to or less than ½ of the aforementioned setting speed V1.

In the aforementioned embodiment, the driving motor 60 is configured by a stepping motor.

According to the configuration, it is possible to accurately control the driving speed of the driving motor 60, so that it is possible to accurately fix a toner image to the paper P passing through between the fixing roller 41 and the pressing roller 42. Thus, it is possible to improve the quality of an image printed on a paper. When the driving motor 60 has been configured with a stepping motor, a motor easily increase in size from the standpoint of preventing step-out due to a torque change. However, in the aforementioned embodiment, it is possible to achieve miniaturization of the driving motor 60, so that it is possible to cancel out an increase in the size of the driving motor 60 due to the employment of the stepping motor, thereby miniaturizing the entire device.

Other Embodiments

In the aforementioned embodiment, the configuration in which the fixing roller 41 is a driving roller and the pressing roller 42 is a driven roller has been described; however, it may be a configuration in which the pressing roller 42 is a driving roller and the fixing roller 41 is a driven roller.

In the aforementioned embodiment, the example in which the fixing device 40 has the pressure switching mechanism 44 has been described; the technology of the present disclosure is not limited to thereto, and the pressure switching mechanism 44 may be abolished. That is, the fixing roller 41 and the pressing roller 42 may also be allowed to always abut each other with predetermined pressing load.

In the aforementioned embodiment, the surface temperature of the fixing roller 41 is detected by the fixing temperature sensor 43 which is a temperature detection unit; the technology of the present disclosure is not limited to thereto, and for example, the surface temperature of the pressing roller 42 may also be detected by the fixing temperature sensor 43. Furthermore, instead of the fixing temperature sensor 43, an in-apparatus temperature sensor that detects in-apparatus temperature may also be employed. That is, the temperature detection unit may also have any configuration as long as it can detect temperature associated with the temperature of the abutting section W of the fixing roller 41 and the pressing roller 42.

Furthermore, in the aforementioned embodiment, both the peripheral surface of the fixing roller 41 and the peripheral surface of the pressing roller 42 are configured with a rubber member; the technology of the present disclosure is not limited to thereto, and for example, the peripheral surface of the pressing roller 42 may also be configured with a rubber member and the peripheral surface of the fixing roller 41 may also be configured with a film member. That is, it is sufficient if at least one of the peripheral surfaces of both rollers 41 and 42 is configured with a rubber member.

What is claimed is:

1. A fixing device comprising:

a fixing roller heated by a heating unit and a pressing roller brought into press-contact with the fixing roller;

a driving motor for driving a driving roller including the fixing roller or the pressing roller;

a temperature detection unit that detects temperature associated with temperature of an abutting section of the fixing roller and the pressing roller; and a control unit that controls the driving motor based on detection temperature detected by the temperature detection unit, wherein at least one of a peripheral surface of the fixing roller and a peripheral surface of the pressing roller is configured with a rubber member, the control unit is configured to determine whether the detection temperature detected by the temperature detection unit is equal to or less than a predetermined temperature when the fixing device is activated, to drive the driving motor at a setting speed set in advance when it is determined that the detection temperature is not equal to or less than the predetermined temperature, and to drive the driving motor at a predetermined low speed lower than the setting speed when it is determined that the detection temperature is equal to or less than the predetermined temperature, and the predetermined low speed is equal to or less than ½ of the setting speed.

2. The fixing device of claim 1, wherein, when it is determined that the detection temperature detected by the temperature detection unit is equal to or less than the predetermined temperature at a time of activation of the fixing device, the control unit is configured to drive the driving motor at the predetermined low speed for a predetermined time and switch a speed of the driving motor to the setting speed, and the predetermined time is preset as a time at which the temperature of the abutting section of the fixing roller and the pressing roller exceeds a predetermined threshold temperature when the predetermined time has lapsed after driving of the driving motor starts at the predetermined low speed.

3. The fixing device of claim 1, wherein the driving motor includes a stepping motor.

4. A fixing device comprising:

a fixing roller heated by a heating unit and a pressing roller brought into press-contact with the fixing roller;

a driving motor for driving a driving roller including the fixing roller or the pressing roller;

a temperature detection unit that detects temperature associated with temperature of an abutting section of the fixing roller and the pressing roller;

a control unit that controls the driving motor based on detection temperature detected by the temperature detection unit; and a pressure switching mechanism that switches between a pressing state in which the fixing roller and the pressing roller abut each other with a predetermined pressing load and a pressing release state in which the fixing roller and the pressing roller abut each other with a pressing load lower than the predetermined pressing load of the pressing state, wherein at least one of a peripheral surface of the fixing roller and a peripheral surface of the pressing roller is configured with a rubber member, the control unit is configured to determine whether the detection temperature detected by the temperature detection unit is equal to or less than a predetermined temperature when the fixing device is activated, to drive the driving motor at a setting speed set in advance when it is determined that the detection temperature is not equal to or less than the predetermined temperature, and to drive the driving motor at a predetermined low speed lower than the setting speed when it is determined that the detection temperature is equal to or less than the predetermined temperature, the control unit is configured to further control the pressure switching mechanism in addition to the driving motor based on the detection temperature detected by the temperature detection unit, and the control unit is configured to allow the fixing roller and the pressing roller to enter the pressing release state by the pressure switching mechanism, then to start driving of the driving motor, and to switch the fixing roller and the pressing roller to the pressing state by the pressure switching mechanism after a predetermined time lapses from the driving start in a case in which it is determined that the detection temperature detected by the temperature detection unit is equal to or less than the predetermined temperature when the fixing device is activated.

5. The fixing device of claim 4, wherein the predetermined time is preset as a time at which the temperature of the abutting section of the fixing roller and the pressing roller exceeds a predetermined threshold temperature when the predetermined time has lapsed after the driving of the driving motor starts.

6. The fixing device of claim 4, wherein, in a case in which it is determined that the detection temperature detected by the temperature detection unit exceeds the predetermined temperature when the fixing device is activated, the control unit is configured to allow the fixing roller and the pressing roller to enter the pressing state by the pressure switching mechanism and then to start the driving of the driving motor.

7. The fixing device of claim 4, wherein, in the case in which it is determined that the detection temperature detected by the temperature detection unit is equal to or less than the predetermined temperature when the fixing device is activated, the control unit is configured to set a driving speed of the driving motor to the predetermined low speed lower than the setting speed set in advance until the predetermined time lapses after the driving of the driving motor starts, and to set the driving speed of the driving motor to the setting speed after the predetermined time lapses.

8. The fixing device of claim 7, wherein the predetermined low speed is equal to or less than ½ of the setting speed.

9. The fixing device of claim 4, wherein the driving motor includes a stepping motor.

* * * * *